US005455868A

United States Patent [19]

Sergent et al.

[11] Patent Number: 5,455,868

[45] Date of Patent: Oct. 3, 1995

[54] GUNSHOT DETECTOR

[75] Inventors: Edward W. Sergent, 11426 Lemon Ave., SW., Arcadia, Fla. 33821; Joseph C. Winkler, Punta Gorda, Fla.

[73] Assignee: Sergent; Edward W., Arcadia, Fla.

[21] Appl. No.: 196,040

[22] Filed: Feb. 14, 1994

[51] Int. Cl.[6] ..... H04R 29/00

[52] U.S. Cl. ..... 381/56; 367/906

[58] Field of Search ..... 381/56, 58, 124; 367/906

[56] References Cited

U.S. PATENT DOCUMENTS

| | | | |
|---|---|---|---|
| 3,341,810 | 9/1967 | Wallen, Jr. . | |
| 3,569,923 | 3/1971 | Nauberek et al. . | |
| 3,614,724 | 10/1971 | Brown et al. . | |
| 4,317,005 | 2/1982 | de Bruyne | 367/906 X |
| 4,349,728 | 9/1982 | Phillips et al. | 367/906 X |
| 4,360,795 | 11/1982 | Hoff . | |
| 4,514,621 | 4/1985 | Knight et al. | 367/906 X |
| 4,691,305 | 9/1987 | Kuck . | |
| 5,029,509 | 7/1991 | Serra et al. | 84/625 |

*Primary Examiner*—Forester W. Isen
*Attorney, Agent, or Firm*—Chase & Yakimo

[57] ABSTRACT

An amplitude responsive detection system analyzes the amplitude characteristic of a received noise and determines whether that characteristic conforms to the predictable audio signature of a gunshot. If a received noise reaches a predetermined amplitude level within a rise time that may be indicative of a gunshot, subsequent amplitude criteria are established representing the decay of the amplitude profile that is expected if the noise is a gunshot. The amplitude criteria are controlled as to both level and occurrence in time to provide a dynamic range that will accommodate near and far gunshots.

11 Claims, 4 Drawing Sheets

Fig. 9
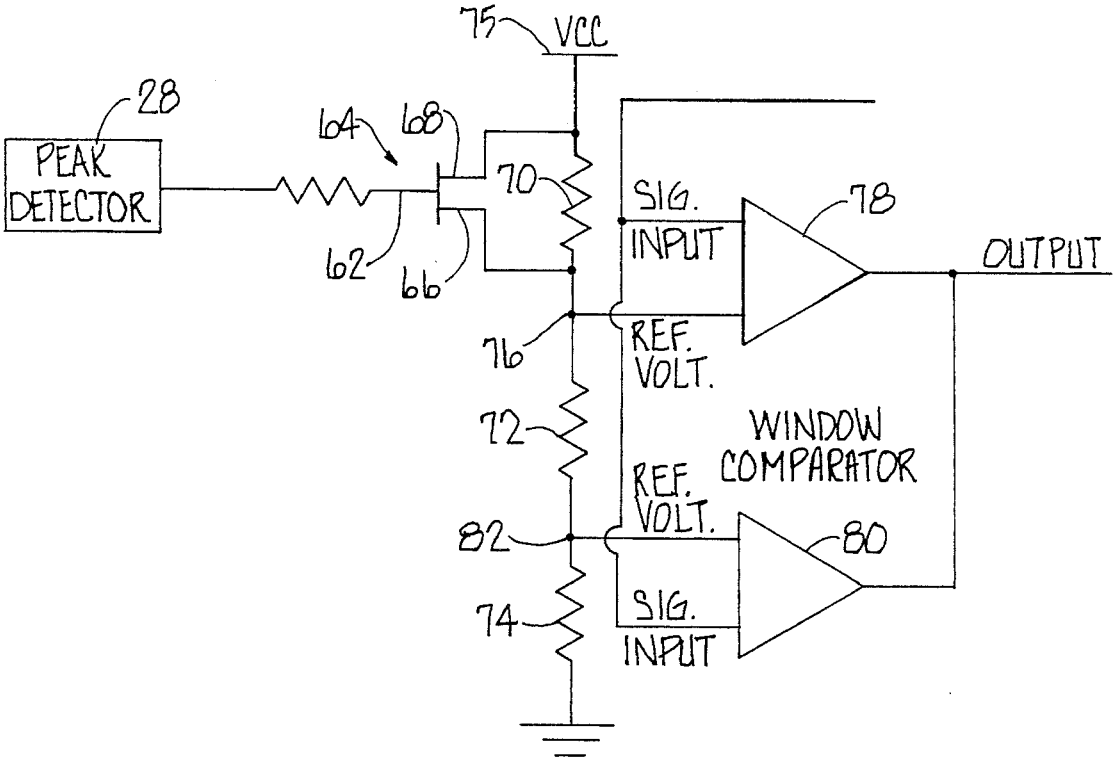
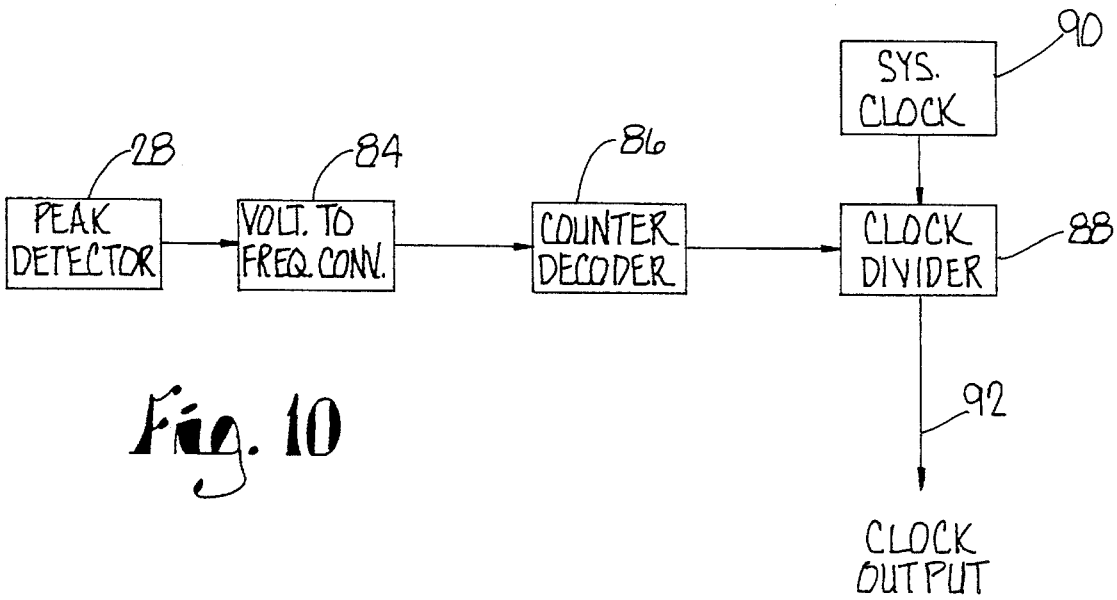
Fig. 10

GUNSHOT DETECTOR

BACKGROUND OF THE INVENTION

This invention relates to an improved method and apparatus for detecting gunshots and recognizing their characteristic waveform as separate and different from other common noises, particularly those encountered in a law enforcement environment.

The ability to distinguish a gunshot, regardless of the type of weapon fired, is often difficult due to the ambient noise typically present in many law enforcement environments. In security applications, detecting a gunshot by ear is not feasible as a police officer or other person capable of recognizing the shot and responding in an appropriate manner is often not present. Therefore, remote detection and monitoring are required in order to adequately protect retail establishments, other public places and dwellings in order to prevent criminal activity and ensure a prompt response when such activity occurs.

It has been found that the audio signature (amplitude envelope) of a gunshot has defined characteristics irrespective of whether the shot is produced by firing a handgun, a rifle or a shotgun. The common thread identifying these various types of gunshots is an extremely sharp rise time characteristic in all cases and a predictable decay in amplitude thereafter. Therefore, although the amplitude of the gunshot will, of course, depend upon the cartridge that is expended, the type of weapon and distance, the amplitude versus time format can be predicted.

SUMMARY OF THE INVENTION

It is, therefore, the primary object of the present invention to provide a method and apparatus for detecting a gunshot by analyzing the waveform of the noise produced to determine if it has the characteristic audio signature of a gunshot.

As corollary to the foregoing object, it is an important aim of this invention to provide such a method and apparatus in which it is determined whether a received noise reaches a predetermined amplitude level within a rise time that may be indicative of a gunshot and, if so, subsequent amplitude criteria are established which, if satisfied, represent the expected decay of the gunshot and verify its presence.

Another important object of the present invention is to provide a method and apparatus as aforesaid in which the amplitude criteria, as to both level and occurrence in time, are established based upon the peak amplitude level detected.

Still another important object of this invention is to provide such a method and apparatus which relies upon the audio signature of a gunshot and distinguishes the gunshot from ambient noise by the amplitude characteristic of that signature, thereby enabling the present invention to be practiced by employing a reliable, relatively inexpensive detection system that utilizes a series of controllable amplitude level detectors to determine whether a received noise fits the profile of a gunshot.

Other objects will become apparent as the detailed description proceeds.

DESCRIPTION OF THE DRAWINGS

FIG. 9 is an electrical schematic diagram of the reference level control circuitry utilized with each of the window comparators.

FIG. 10 is a block diagram showing the control components that determine the system clock frequency.

DETAILED DESCRIPTION

Figure 1:
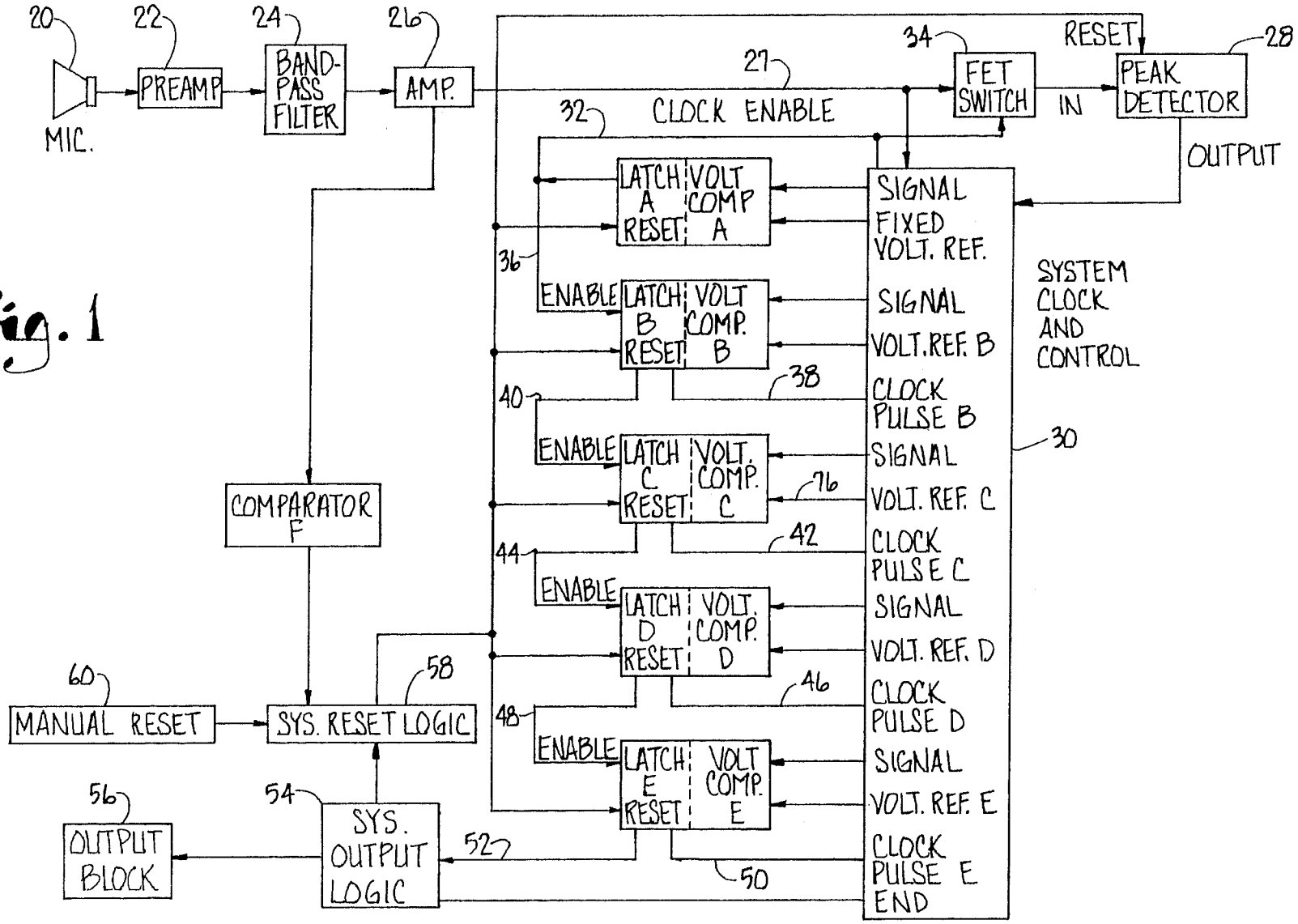
FIG. 1 is a block diagram of the gunshot detector system of the present invention.
Figure 2:
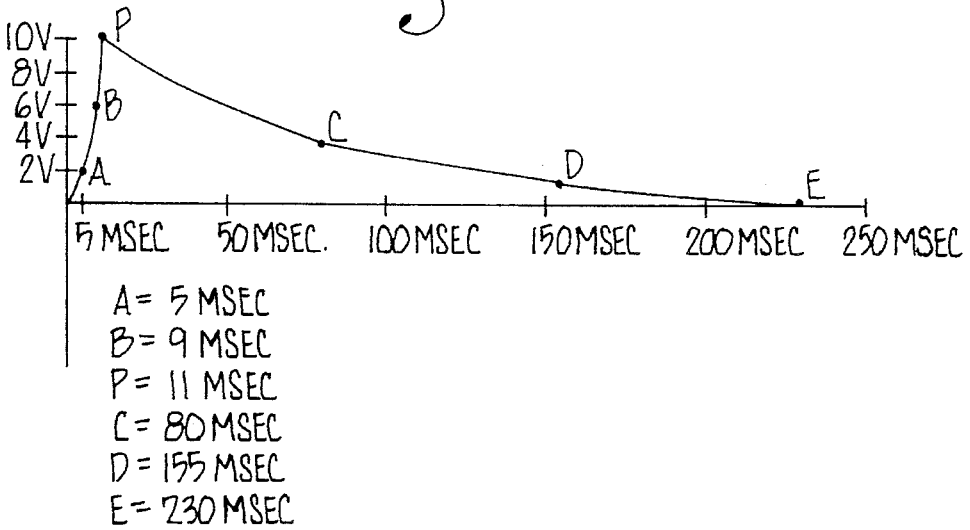
FIG. 2 is a graph showing the positive amplitude envelope of an audio signal produced by a received gunshot, points identified on the waveform being illustrative of the operation of the system of FIG. 1.

The block diagram of FIG. 1 illustrates an embodiment of the present invention in which the audio signature of a gunshot is verified. As discussed above, the common thread identifying various types of gunshots is the extremely sharp rise time characteristic and the predictable decay in amplitude. The composite waveform of a typical gunshot is illustrated in FIG. 2. The amplitude versus time format of the graph shows the following reference points:

A: threshold for system enable (at 5 milliseconds)

B: time=4 milliseconds after system enable

P: variable point in time that the peak amplitude occurs

C: time=75 milliseconds after system enable

D: time=150 milliseconds after system enable

E: time=225 milliseconds after system enable

Figure 3:
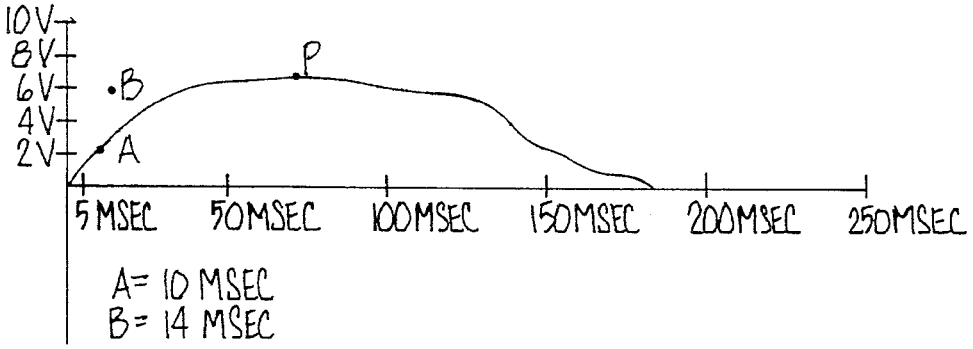
FIGS. 3–6 are audio waveforms representative of other expected noises in a law enforcement environment.
Figure 4:
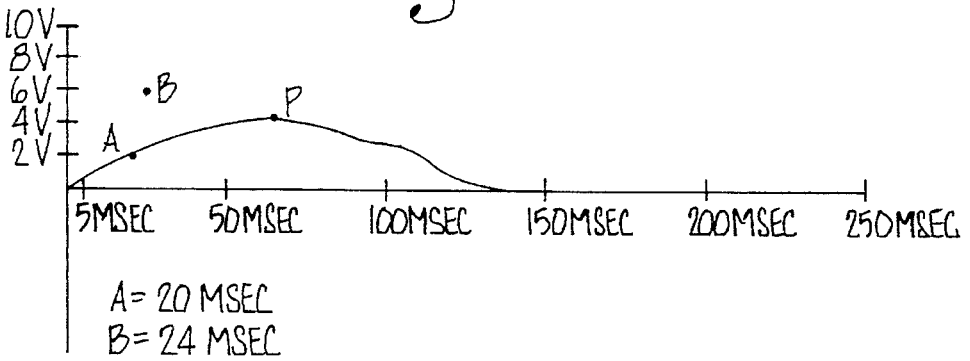
Figure 5:
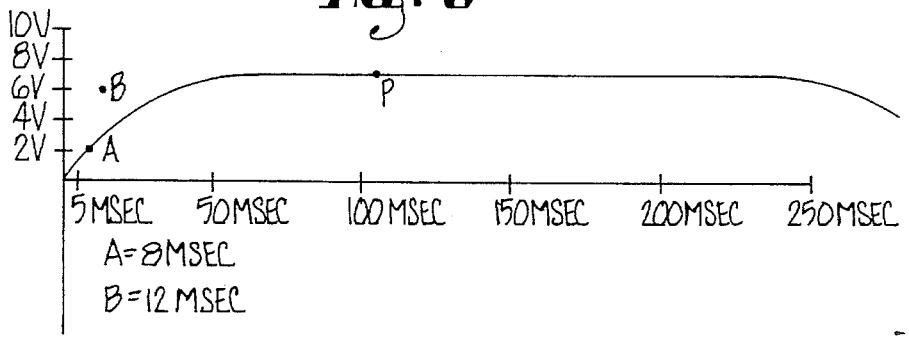
Figure 6:
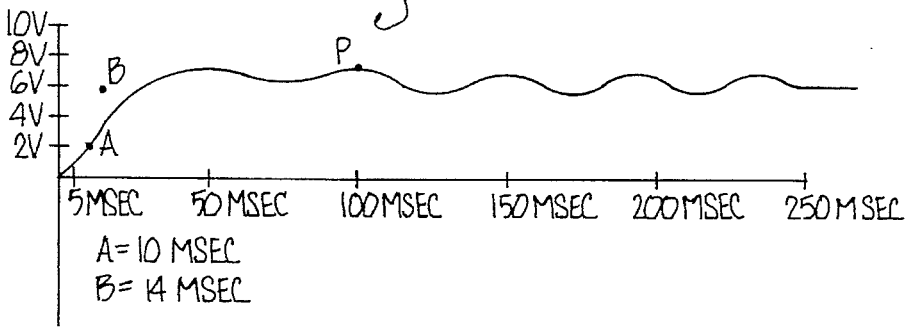

These time references and corresponding relative amplitude levels establish amplitude criteria which, if satisfied in the example illustrated in FIG. 2, identify the audio signatures of gunshots and also discriminate against other sources of noise expected to be encountered in a law enforcement operating environment. Such expected noises are, for example, a passing semi-tractor/trailer truck, FIG. 3; a passing automobile, FIG. 4; automobile horns, FIG. 5; emergency vehicle sirens, FIG. 6; and wind noise, electrical system noise, thunder, etc. (not shown). Referring to FIG. 2, if the amplitude criteria at points A and B are satisfied, the waveform then peaks at P and begins a predictable decay. By analyzing the amplitude at points C, D and E, the present invention determines the goodness of fit of the waveform along its expected curve. If any of the subsequent points are not valid, then the system is disabled and resets. If all of the points are valid, then the waveform is deemed to have originated from a gunshot and the system output is delivered.

Referring again to FIG. 1, the block diagram of the system, the sound (incoming noise) is received by an audio frequency microphone 20, converted to an audio signal and then fed to an audio preamplifier 22. From the preamp 22 it is then filtered by a bandpass filter 24 whose pass band, for example, is 1 kHz to 10 kHz. This filtered signal is then amplified at 26 to raise it to the desired level for analysis.

The signal output of the audio amplifier 26 on line 27 is fed simultaneously to a peak detector 28 and to the system clock and control block 30. The peak detector 28 is an operational amplifier configured as a voltage peak detector with a reset input. The output of the peak detector 28 is fed into the system control block 30 and serves as an initial reference level from which the goodness of fit curve control points are derived. The audio signal from the amplifier 26 is distributed by the control block 30 to the signal input lines of each of five level detectors consisting of a voltage comparator and a latch, the comparator and latch components of the detectors being designated A, B, C, D and E in FIG. 1 to correspond with the criteria points A, B, C, D and E illustrated in FIG. 2. Comparators A and B operate as threshold detectors, while comparators C, D and E comprise dual window comparators. It will be appreciated that a greater number of window comparators may be employed to establish additional criteria points if desired.

Comparator A has a fixed reference level set somewhat above the level of the expected ambient noise. For example if the expected ambient noise level is 1.5 volts, the reference level could be set at 3.0 volts. This establishes the minimum signal level or threshold necessary to activate the system. Once this threshold is exceeded, the output of comparator A shifts to a logic level "1" and sets latch A. The output of latch A is thereby set to a logic level "1" and is routed simultaneously to a FET switch 34 via line 32 to enable the peak detector 28 and the system clock to begin a timing sequence, and to the enable line 36 of latch B. The reference voltage level on comparator "B" is also a fixed reference and is set at the minimum level required to be considered for analysis, in the present example, 6.0 volts. Clock pulse "B" on line 38 occurs 4 milliseconds after the system clock is started, and if the output of comparator B is high, indicating the 6.0 volt reference threshold has been crossed, then latch B is set. This timing and comparison tests the rise time characteristic of the waveform to determine if further analysis is required. If latch B fails to set, then the signal is disregarded and the system will cease processing until it later resets. If latch B sets, the waveform has met the first criteria and latch B enables latch C via line 40.

Comparator C is a dual window comparator configured to provide a logic "1" output when the input signal voltage is between or inside the window established by an input reference voltage "C" and an offset reference voltage (discussed below). In the present example, clock pulse "C" on line 42 occurs at approximately 75 milliseconds after the system is enabled, and if the voltage has peaked at 10 volts and has now decayed to a voltage between 4.0 and 3.6 volts, then latch C sets. If the latch does not set, then the system is inactive until a reset occurs.

If latch C sets, then latch D is enabled via line 44. Comparator D is also a dual window comparator. The clock pulse "D" (line 46) occurs approximately 150 milliseconds after the system enable and if the voltage has decayed to a level between 1.6 and 1.2 volts, latch D sets enabling the latch E via line 48. If not, then the system is inactive until a reset occurs.

Comparator E is another dual window comparator. Clock pulse "E" (line 50) occurs approximately 225 milliseconds after system enable. If the voltage has decayed to less than 300 millivolts, the latch E is set and all of the check points for goodness of fit have been deemed valid. The validating output of latch E is sent over line 52 to the system output logic 54. If latch E does not set, the system is inactive until a reset occurs.

The output logic 54 is a conventional arrangement of gates that generates a resultant pulse and delivers the same to an output block 56, or to a system reset 58 depending on whether or not latches A through E have been set in their respective time constraints. If so, the resulting pulse is directed to the output block 56 which reports that the goodness of fit criteria have been met, and the waveform has been determined to fit the profile of a gunshot. The output block 56 may include an indicator light, an audible alert, or an analog or digital signal source to modulate a carrier or interface with a radio transmitter, telephone, cellular link, a GPS, or other satellite positioning and reporting system.

The system reset logic 58 is connected to the reset inputs of the five latches A through E and the peak detector 28, and to a voltage comparator F, responsive to the output of amplifier 26, that is used to control the system reset. If a signal is applied to the system that fails to meet the goodness of fit criteria established, but is of sufficient amplitude to enable the system, then at the end of the clock cycle time the output of comparator F will be high and prevent the reset logic 58 from resetting the system. The clock stops on clock pulse "E" and the system shuts down until the amplitude of the noise falls below the comparator F reference level. At that point the system reset is generated and the system is ready to process the next waveform. If the system is tripped (output block 56 activated), it then requires a manual reset from the operator of the device as illustrated at 60.

Referring to FIGS. 9 and 10, the manner in which the peak detector 28 sets the amplitude criteria is shown in detail. FIG. 9 is a simplified illustration of the circuitry associated with each of the window comparators C, D and E that establishes the voltage window of the comparator in response to the output of the peak detector 28. The circuitry will be described with reference to comparator C.

Referring to FIG. 9, the peak voltage of the audio signal from amplifier 26 is detected by the peak detector 28 and is utilized to drive the gate 62 of a junction field effect transistor (JFET) 64 having a source 66 and a drain 68. The voltage applied to the gate 62 determines the gate bias current which, in turn, controls the source-drain junction current. Varying the gate current thus causes a corresponding change in the source-drain current and, therefore, changes the resistance across the source-drain junction. A fixed resistor 70 is connected in parallel with source 66 and drain 68, this parallel combination comprising a voltage controlled resistance in series with fixed resistors 72 and 74. Accordingly, a series voltage divider is provided between the supply voltage terminal 75 and ground to establish the reference voltage "C" (FIG. 1) at 76 at an input of an operational amplifier 78. The result is a voltage at 76 having a level that is dependent upon the peak voltage of the input audio signal.

A second operational amplifier 80 provides the window comparator configuration. A second, offset reference voltage for amplifier 80 is provided at 82 by the voltage divider resistors 72 and 74 to define a voltage window, e.g., 3.6 to 4.0 volts in the present example for comparator C. As this same voltage controlled resistor arrangement is employed for comparators D and E, they likewise set their successively lower voltage windows in accordance with the peak voltage level detected by the peak detector 28. Resistors 72 and 74 are selected for each of the comparators C, D and E to establish the progressively lower voltage levels indicative of a decaying gunshot waveform.

Figure 7:
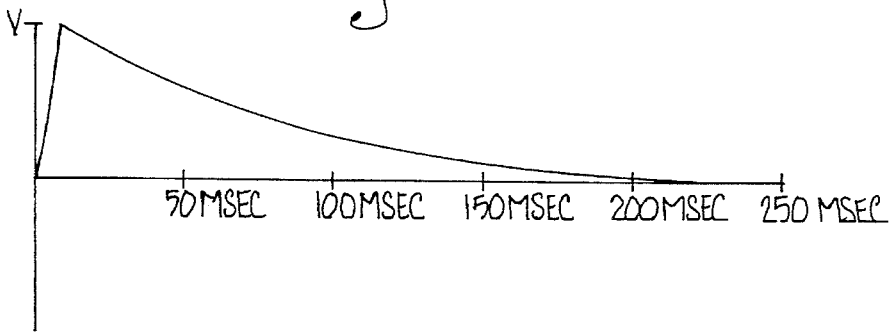
FIGS. 7 and 8 are comparative waveforms showing the signatures of near and far gunshots respectively.
Figure 8:
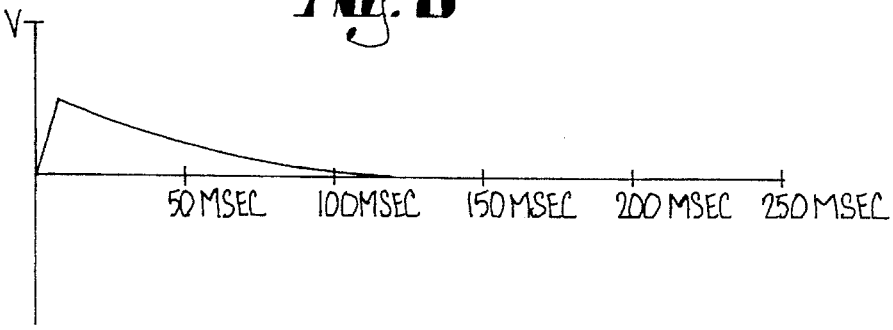

The circuitry in FIG. 9 sets the levels of the reference level voltages for each of the comparators C, D and E, whereas the diagram shown in FIG. 10 shows the manner in which the timing of the amplitude criteria is determined. The voltage output from the peak detector 28 drives a voltage-to-frequency converter 84 (for example, a phase locked loop) in the system control block 30. The output frequency from converter 84 is then counted by a counter decoder 86 which delivers a binary coded output to a clock divider 88. The clock divider 88 is a variable divider under the control of the decoded frequency which divides the frequency of the clock signal from the system clock 90 in order to produce a pulse train at the clock output 92 having a repetition rate which is inversely proportional to the level of the voltage peak detected by the peak detector 28. For example, if the output from the peak detector 28 is 7 volts, the system clock frequency would be divided by 7. If the output voltage from the peak detector 28 is 10 volts, the system clock frequency would be divided by 10 to provide a lower clock frequency to lengthen the clock times for levels C, D and E. Therefore, the amplitude points established by comparators C, D and E are placed at times after system enable which shape the goodness of fit curve to fit the overall amplitude envelope of the applied audio signal. This imparts to the system the capability of operating on a wider dynamic range of signals thereby increasing its sensitivity and range. As illustrated in FIGS. 7 and 8, the signatures of near and far gunshots are alike but it will be appreciated that the amplitude and decay times are different. However, the amplitude at a given time is essentially proportional to the peak amplitude over a substantial portion of the decay period and thus is predicted in the system of the present invention.

Having thus described the invention, what is claimed as new and desired to be secured by Letters Patent is as follows:

1. A method of detecting a gunshot by analysis of the amplitude characteristic of a received noise, said method comprising the steps of:

(a) converting a received noise into an electrical signal and determining whether said signal reaches a predetermined amplitude level within a rise time that is indicative of a gunshot, (b) establishing, responsive to said signal, subsequent amplitude criteria representing an expected decay of a gunshot, and (c) indicating the detection of a gunshot if said signal conforms to said criteria.

2. The method as claimed in claim 1, wherein said step (b) includes detecting the peak amplitude of said signal, and establishing said criteria in accordance with the peak amplitude level detected.

3. The method as claimed in claim 1, wherein said step (b) includes the establishment of a plurality of successively decreasing amplitude levels.

4. The method as claimed in claim 1, wherein said step (b) includes detecting the peak amplitude of said signal, and establishing a plurality of successively decreasing amplitude levels having relative values and a time spacing based upon the peak amplitude level detected.

5. Apparatus for detecting a gunshot comprising:

means responsive to a received noise for converting the same into an audio signal, level and time sensing means responsive to said audio signal for determining whether a predetermined amplitude level is reached within a rise time that is indicative of a gunshot, and variable level detector means under the control of said level and time sensing means for establishing subsequent amplitude criteria representing an expected decay of a gunshot, and delivering an output signal if said audio signal meets said criteria.

6. The apparatus as claimed in claim 5, wherein said time and level sensing means includes means for detecting the peak amplitude of said audio signal, and wherein said variable detector means establishes said criteria in accordance with the peak amplitude level detected.

7. The apparatus as claimed in claim 5, wherein said variable detector means establishes a plurality of successively decreasing amplitude levels representing the expected decay of a gunshot.

8. The apparatus as claimed in claim 5, wherein said time and level sensing means includes means for detecting the peak amplitude of said audio signal, and wherein said variable detector means establishes a plurality of successively decreasing amplitude levels having relative values and a time spacing based upon the peak amplitude level detected.

9. The apparatus as claimed in claim 8, wherein said variable detector means includes a plurality of controllable amplitude level detectors for establishing said plurality of successively decreasing amplitude levels in response to the peak amplitude level detected.

10. The apparatus as claimed in claim 9, wherein each of said level detectors includes a window comparator responsive to the detected peak amplitude for establishing a voltage window indicative of a detected gunshot.

11. The apparatus as claimed in claim 9, wherein said variable detector means further includes timing means responsive to the detected peak amplitude for enabling said level detectors at times corresponding to a goodness of fit of said audio signal indicative of a gunshot.

* * * * *